US006398073B1

(12) United States Patent
Nicolle

(10) Patent No.: US 6,398,073 B1
(45) **Date of Patent: *Jun. 4, 2002**

(54) FLUID DISPENSING SYSTEM WITH COLLAPSIBLE CONTAINER

(75) Inventor: Kenneth Nicolle, Zephyr (CA)

(73) Assignee: Bag O Water Limited

( * ) Notice: Subject to any disclaimer, the term of this patent is extended or adjusted under 35 U.S.C. 154(b) by 0 days.

This patent is subject to a terminal disclaimer.

(21) Appl. No.: 09/625,058

(22) Filed: Jul. 24, 2000

(51) Int. Cl.[7] ..... B67D 5/08

(52) U.S. Cl. ..... 222/67; 222/105; 222/185.1; 383/111

(58) Field of Search ..... 222/83, 105, 185.1, 222/67; 383/111

(56) References Cited

U.S. PATENT DOCUMENTS 3,848,776 A * 11/1974 Schieser ..... 222/105
4,527,716 A * 7/1985 Haas et al. ..... 222/105
4,865,218 A * 9/1989 Derby et al. ..... 383/111
5,281,027 A * 1/1994 Thrall ..... 383/111
5,691,015 A * 11/1997 Tsukamoto et al. ..... 383/111
6,098,844 A * 8/2000 Nicolle ..... 222/185.1
6,149,034 A * 11/2000 Amberg et al. ..... 222/83

* cited by examiner

*Primary Examiner*—Philippe Derakshani
(74) *Attorney, Agent, or Firm*—Gowling Lafleur Henderson LLP

(57) ABSTRACT

A fluid dispensing system comprises a sealed collapsible plastic bag for retaining fluid therein, and support means for supporting the plastic bag. The support means comprises a bowl-shaped carrier portion for retaining the plastic bag therein, a collar portion for supporting the carrier portion, and at least one cooling element disposed about the carrier portion for cooling the fluid in the plastic bag. The support means includes a spigot for puncturing the plastic bag, either under its own weight or with a downward force being exerted on the bag, when the bag is positioned on the carrier portion. The spigot is positioned in the carrier portion adjacent the lowermost portion thereof, and is shaped for sealing the plastic bag to the spigot after being punctured by the spigot. The spigot includes a fluid passageway, and a fluid inlet in communication with the fluid passageway for draining the fluid from the plastic bag. A conduit, coupled to the fluid passageway, is provided for dispensing the fluid from the plastic bag. The conduit includes a valve for controlling the rate flow of water through the conduit.

17 Claims, 7 Drawing Sheets

PRIOR ART

110

FLUID DISPENSING SYSTEM WITH COLLAPSIBLE CONTAINER

FIELD OF THE INVENTION

The present invention relates to a system for dispensing fluids. In particular, the present invention relates to a novel fluid dispensing system for dispensing fluid from a fluid storage vessel.

BACKGROUND OF THE INVENTION

Conventional domestic fluid dispensers are usually free standing devices which dispense sterilized or mineral water from large rigid water bottles. The rigid water bottles have a large body portion and a narrow neck portion, and are coupled to the water dispenser by inverting the bottle and positioning the mouth of the bottle in the reservoir of the water dispenser. Air, introduced into the water bottle through the mouth, allows water to be dispensed from the inverted bottle until the water level in the reservoir reaches the mouth of the bottle. Since the water bottle is rigid, the water remaining in the inverted bottle is retained in the bottle due to the difference between the air pressure external to the inverted bottle and the air pressure inside the bottle. Water is then dispensed from the reservoir through a conduit opening into the bottom of the reservoir. A valve coupled to the conduit restricts the flow of water from the conduit until a quantity of water is desired. When the level of water in the reservoir falls below the mouth of the water bottle, air enters the water bottle, allowing water to flow from the bottle until the water level in the reservoir reaches the mouth of the bottle.

Although conventional domestic water dispensers are widely used, they are deficient in a number of respects. First water bottles used in the conventional domestic water dispenser usually contain a large quantity of sterilized water, typically in the region of about 5 gallons. Therefore, it is often difficult to invert and properly locate the mouth of the bottle in the reservoir without spilling a quantity of the water.

Second, to prevent water from continuously flowing from the water bottle while the water bottle is inverted, the water bottles used with such water dispensers are fabricated from a thick, rigid plastic material. Due to the cost and the substantial amount of plastic used in fabricating these bottles, the water bottles are usually sterilized and reused. As a result, the cost of shipping the empty water bottle back to the supplier for sterilization and reuse are adsorbed by the consumer through increased water costs.

Third, in order for the mouth of the water bottle to be positioned in the reservoir of the cooler, the water bottles must be necked, as described above. However, the presence of the neck increases the difficulty in sterilizing the water bottles since it may limit the ability of the sterilizing agents to reach all the interior parts of the bottle, even when large quantities of sterilizing agents are used. Further, it is generally not possible to use heat sterilization on plastic bottles. Although, sterilization using ultraviolet light is possible, ultraviolet light sterilization may lead to an incomplete result.

Fourth, with the necessity of sterilizing the water bottles after each use, over time the rigid plastic water bottles may develop cracks or holes. If such failures occur while the water bottle is inverted in the water dispenser, air will enter the water bottle and allow water to flow uncontrollably from the mouth of the water bottle, allowing the reservoir to eventually over flow. This water over flow can expose the purchaser's premises to the risk of water damage.

Accordingly, there remains a need for a fluid dispensing system which reduces the effort required to couple the fluid storage vessel to the fluid dispenser, and which reduces the shipping costs associated with delivering quantities of fluid while also reducing the risk of failure of the storage vessel. Further, there remains a need for a water dispensing system which facilitates the delivery of sterilized water.

SUMMARY OF THE INVENTION

In accordance with the invention, there is provided a fluid dispensing system which attempts to overcome or at least ameliorate the problems associated with the prior art fluid dispensing systems.

The fluid dispensing system, according to the invention, comprises a collapsible sealed enclosure for retaining fluid therein and support means for supporting the enclosure. The support means includes a spigot for puncturing the enclosure, either under its own weight or with a downward force being exerted on the enclosure, when the enclosure is positioned on the support means. The spigot includes a fluid passageway for draining the fluid therethrough. A conduit, coupled to the fluid passageway, is provided for dispensing the fluid from the enclosure.

In the preferred embodiment of the invention, the sealed enclosure comprises a sealed plastic bag containing sterilized water. The support means comprises a carrier portion for retaining the plastic bag therein, a collar portion for supporting the carrier portion, and at least one cooling element disposed about the carrier portion for cooling the water in the plastic bag. The spigot is positioned in the carrier portion adjacent the lowermost portion thereof, and is shaped for sealing the plastic bag to the spigot after being punctured by the spigot. The spigot includes a fluid inlet in fluid communication with the fluid passageway for draining the fluid from the plastic bag. The fluid inlet is positioned a distance above the support means for reducing the possibility of the fluid becoming contaminated through contact with the support means. The conduit includes a valve for controlling the rate flow of water through the conduit.

To dispense water from the bag, the bag is placed on the carrier portion. The weight of the water in the plastic bag upon the spigot causes the spigot to puncture the lowermost portion of the plastic bag while simultaneously sealing the plastic bag to the spigot. As a result, water is allowed to flow from the plastic bag, and is controllably dispensed from the conduit through operation of the valve. When the cooling elements are active, the cooling elements cool the water in the plastic bag, allowing cooled water to be dispensed. When the supply of sterilized water is exhausted, the plastic bag is removed from the support means and replaced with a full sealed plastic bag of sterilized water.

In one variation of the invention, the collar portion is dimensioned for positioning the carrier portion above the cooling reservoir of a conventional water dispenser. The conduit includes a ballcock supply valve disposed within the cooling reservoir for controlling the flow of water from the plastic bag into the cooling reservoir.

BRIEF DESCRIPTION OF THE DRAWINGS

The preferred embodiment of the invention will now be described, by way of example only, with reference to the drawings, in which.

DETAILED DESCRIPTION OF A PREFERRED EMBODIMENT

Before describing the fluid dispensing system, in accordance with the invention, a conventional water cooler will be described first, followed by a description of the preferred embodiment of the invention.

Figure 1:
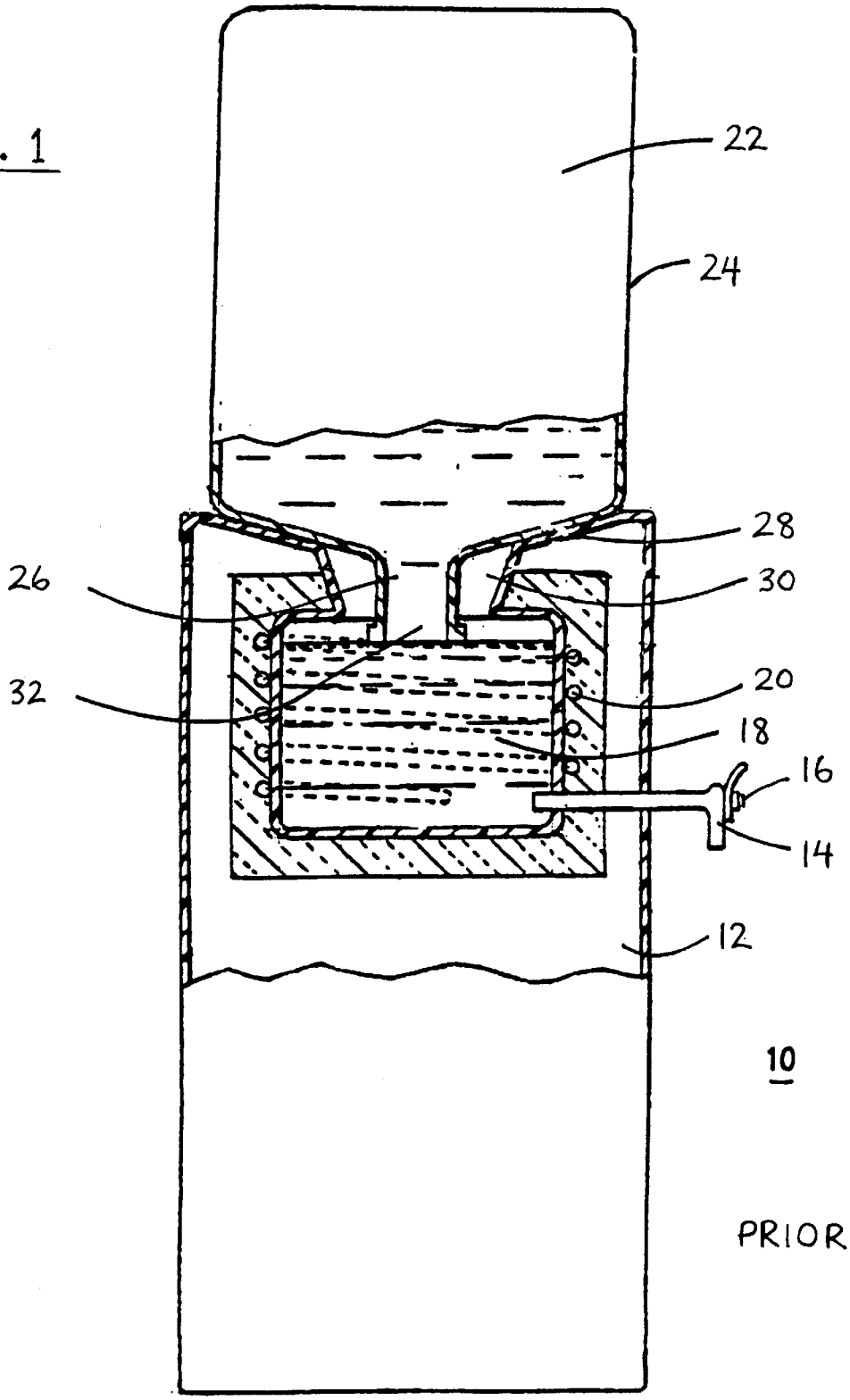
FIG. 1 is a longitudinal cross-sectional view of a conventional water cooler.

Turning to FIG. 1, a conventional water cooler, denoted generally as 10, is shown comprising a free-standing housing 12, and an access tap 14 including a flow-control valve 16 for allowing water to be drawn from the cooler 10. The cooler 10 includes a reservoir 18 within the housing 12, and is open at the top to allow water to empty into the reservoir 18. A plurality of cooling elements or refrigerating coils 20 are arranged around the reservoir 18 to cool the water prior to being drawn from the cooler 10. A rigid plastic water bottle 22 having a large body portion 24 and a narrow neck portion 26 is located upside down resting in a shallow saucer-shaped portion 28 at the top of the water cooler housing 12. The shallow saucer-shaped portion 28 has a simple aperture 30 through which the neck 26 of the bottle 22 protrudes, so that the neck 26 is located within the cooling reservoir 18. The mouth 32 of the water bottle 22 is located just below a desired upper water level of the cooling reservoir 18.

In operation, the mouth 32 is located below the water level in the reservoir 18 and air is prevented from entering the water bottle 22. Since the water bottle 22 is rigid, the water is prevented from pouring out of the bottle 22 due to the difference between the air pressure external to the bottle 22 and the air pressure inside the bottle 22. When a portion of water is desired, the user depresses the flow-control valve 16 in the access tap 14, causing a volume of water to flow out the access tap 14 from the reservoir 18, and the level of water in the reservoir 18 to decrease. When the level of water in the reservoir 18 is drops below the mouth 32 of the water bottle 22, air enters the water bottle 22 allowing a quantity of water to flow from the water bottle 22 into the reservoir 16. The flow of water from the water bottle 22 continues until the water level in the reservoir 18 reaches the mouth 32 of the bottle 22, thereby terminating the flow of air into the water bottle 22.

Figure 2:
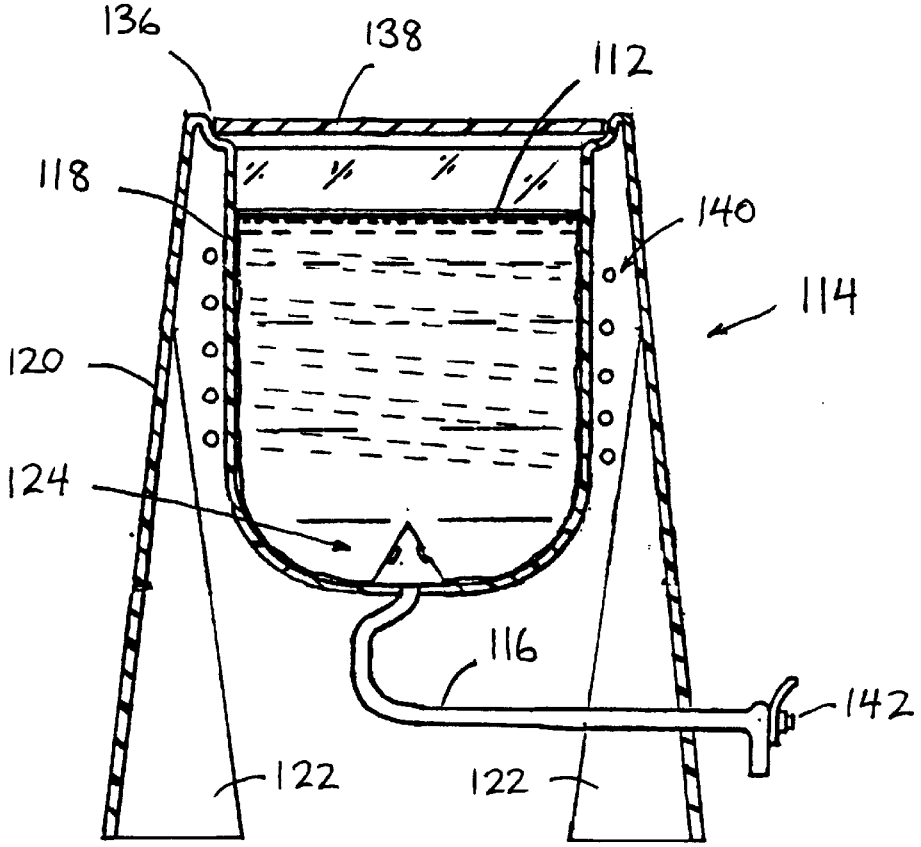
FIG. 2 is a longitudinal cross-sectional view of a fluid dispensing system, according to the invention, showing the sealed enclosure, the support means, the spigot and the conduit.

Turning now to FIG. 2, a fluid dispensing system 110, in accordance with the preferred embodiment of the invention, is shown comprising a collapsible sealed enclosure 112 for retaining fluid therein, support means 114 for supporting the enclosure 112, and a conduit 116 for dispensing the fluid from the sealed enclosure 112. Preferably, the sealed enclosure 112 is fabricated from food grade polyethylene sheet having a strength sufficient for retaining the fluid in the enclosure 112 and a thickness between 2 mil and 6 mil. In one implementation of the invention, the sealed enclosure 112 is fabricated from a polyethylene sheet, 3 mil in thickness, and retains sterilized water therein. However, the sealed enclosure 112 may be fabricated from other suitable materials or from a different thickness of polyethylene sheet if desired. Further, the sealed enclosure may contain other fluids, such as milk, juice, wine or soda, or may even contain gases, if the application so required.

The support means 114 comprises a carrier portion 118, and a collar 120 supporting the carrier portion 118. The carrier portion 118 is shaped as a paraboloid of revolution and retains the sealed enclosure 112 therein. Preferably, the support means 114 is fabricated from food grade virgin plastic resin, and the carrier portion 118 includes a plurality of integrally-molded strengthening ribs 122 extending inwardly from the collar 120 to impart stability to the support means 114. The carrier portion 118 is also integrally-molded with the collar 120. However, it should be understood that the carrier portion 118, the collar 120 and the ribs 122 may be manufactured as separate elements, and may be fabricated from other suitable materials if desired. Further, the paraboloid of revolution shape of the carrier portion 118 facilitates cleaning of the support means 114. However, as will become apparent, as a primary function of the carrier portion 118 is merely to support the sealed enclosure 112 while fluid is being drained from the sealed enclosure 112, the carrier portion 118 may adopt other shapes suitable for accomplishing this function without departing from the scope of the invention.

Figure 3:
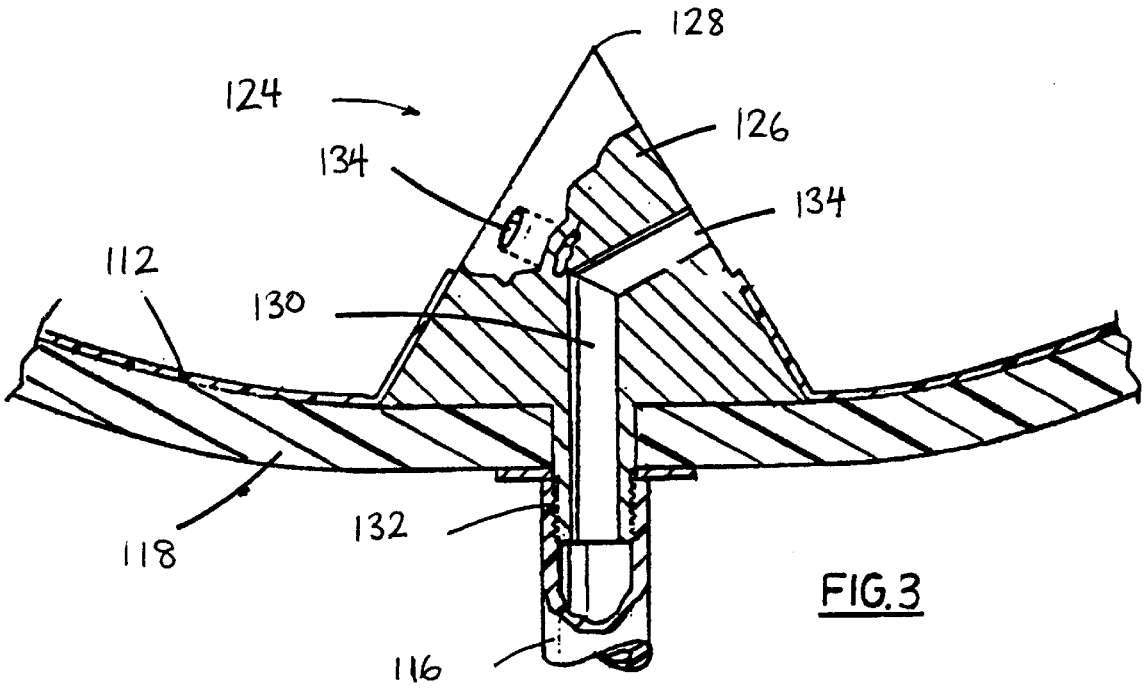
FIG. 3 is a magnified cross-sectional view of the spigot shown in FIG. 2.

A spigot 124 is provided in the carrier portion 118 for draining fluid from the sealed enclosure 112, and is positioned adjacent the lowermost portion of the carrier 118 to facilitate the flow of fluid from the sealed enclosure 112. As shown in FIG. 2, and with greater detail in FIG. 3, the spigot 124 extends through the carrier portion 118 and terminates in a sharp end for puncturing the sealed enclosure 112. As will be discussed below, fluid is dispensed from the sealed enclosure 112 by first positioning the enclosure 112 on the support means 114 and allowing the spigot 124 to puncture the sealed enclosure 112. To prevent fluid loss between the enclosure 112 and the support means 114 after the sealed enclosure 112 is punctured, preferably the spigot 124 comprises aconical head portion 126 terminating in a sharp apex 128. The conical shape of the spigot 124 causes the punctured portion of the sealed enclosure 112 to exert a lateral sealing force against the spigot 124 under the weight of the fluid in the sealed enclosure 112, thereby sealing the enclosure 112 to the spigot 124.

As shown in FIG. 3*a,* the head portion 126 of the spigot 124 extends upwards from the upper surface of the carrier portion 118, and includes a fluid passageway 130 extending through an aperture in the carrier portion 118. The outer surface of the fluid passageway 130 includes external screw threading 132 adjacent the end of the fluid passageway 130. Corresponding internal threads are provided in the conduit 116 for securing the spigot 124 to the carrier portion 118.

The spigot 124 includes a plurality of fluid inlet ports 134 in fluid communication with the fluid passageway 130 for draining the fluid from the sealed enclosure 112. The fluid inlet ports 134 are positioned in the side wall of the head portion 126 adjacent the lowermost portion of the carrier portion 116 and the lowermost portion of the sealed enclosure 112 to ensure that substantially all of the fluid in the enclosure 112 is dispensed. However, as the punctured portion of the sealed enclosure 112 is forced against the spigot 124 under the weight of the fluid in the sealed enclosure 112, the punctured portion may turn up slightly from the lowermost portion of the carrier portion 118, thereby exposing the fluid to a risk of contamination from the outer surface of the sealed enclosure 112. Accordingly, it is preferable that the fluid inlet ports 134 are positioned a distance above the lowermost portion of the carrier portion 118. Favourable results have been achieved with the fluid inlet ports 134 positioned between 0.25 cm and 1.0 cm, and preferably between 0.25 cm and 0.5 cm, above the lowermost portion of the carrier portion 118. For added protection against contamination, in one variation the fluid inlet ports 134 are positioned in the apex 128 of the head portion 126.

In one implementation of the invention, the support means 114 also includes a shoulder 136 adjacent the uppermost portion of the carrier portion 118, and a cover 138 resting on the shoulder 136 for further protection against contamination. In addition, a plurality of cooling elements 140 are disposed between the carrier portion 118 and the collar 120 for cooling the fluid in the sealed enclosure 112. Alternately, the cooling elements 140 may be replaced with heating elements for dispensing heated fluid from the sealed enclosure 112. To facilitate the efficient cooling or heating of the fluid contained in the sealed enclosure, preferably the carrier portion 118 is fabricated from food grade virgin plastic resin with a thickness of about 125 thou (⅛ inch). Alternately, the cooling elements 140 may be positioned externally to the collar 120 if cooling or heating efficiency is not a primary concern.

The conduit 116 includes a user-operable valve 142 for controlling the rate flow of water through the fluid passageway 130 and the conduit 116.

Figure 4B:
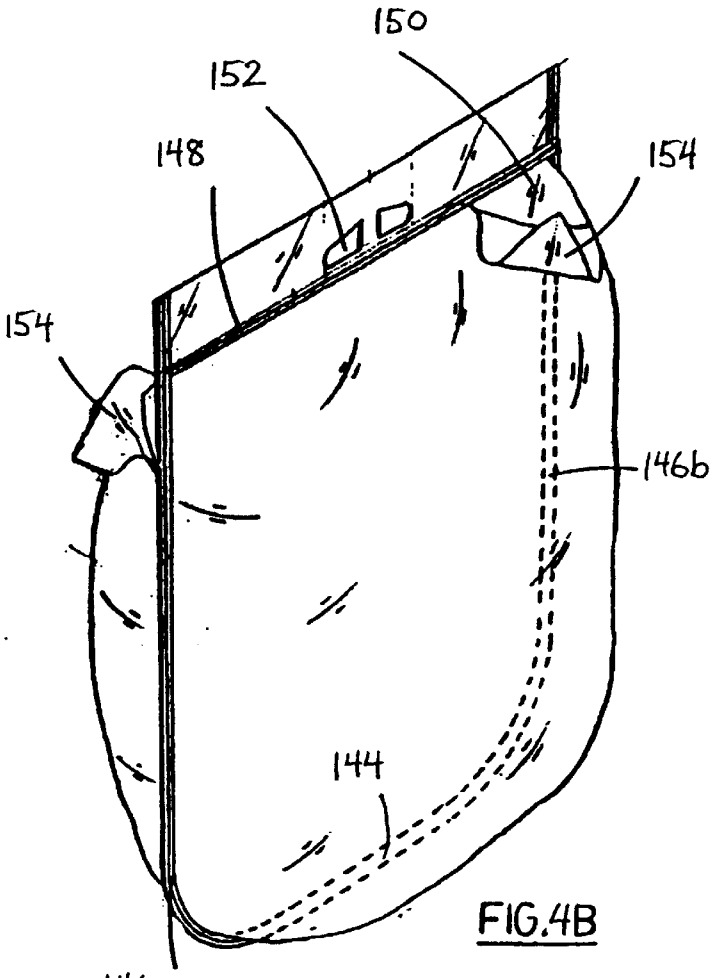
FIG. 4B is a perspective view of the sealed enclosure shown in FIG. 4A.
Figure 4A:
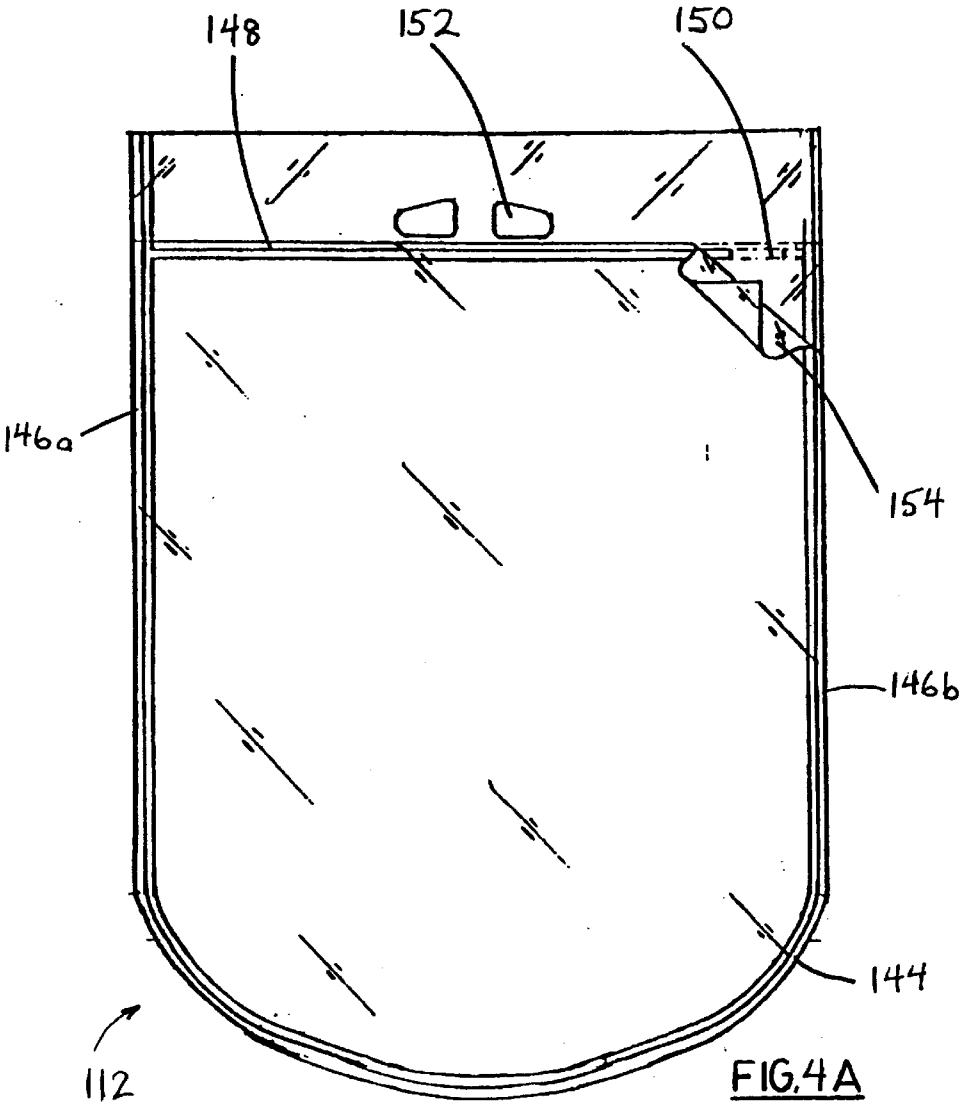
FIG. 4A is a side plan view of the sealed enclosure depicted in FIG. 2, showing the peel-off protective cover.

The collapsible sealed enclosure 112 will now be described with reference to FIGS. 4A and 4B. As discussed above, preferably the enclosure 112 is fabricated from polyethylene sheet. The use of polyethylene sheet provides a lower cost alternative to the delivery of sterilized water than the conventional water bottle 20. Since the sealed enclosure 112 is collapsible and less expensive to manufacture than the conventional water bottle 20, the enclosure 112 may be discarded after the supply of sterilized water contained in the enclosure 112 is exhausted. As a result the shipping and resterilization costs associated with the prior art water dispenser 10 are not carried forward into the present invention.

In one implementation of the invention, the enclosure 112 comprises a pair of substantially identical polyethylene sheets which are joined together through heat seals at the common bottom edge 144, side edges 146*a*, 146*b*, and top edge 148 of the polyethylene sheets. However, the heat seal at the top edge 148 only extends across a portion of the top edge 148, leaving a small aperture 150 for insertion of a filling nozzle (not shown). After the enclosure 112 is filled with the desired fluid, the filling nozzle is removed from the aperture 150, and the aperture 150 is sealed.

In another implementation of the invention, the enclosure 112 comprises a pair of substantially identical polyethylene sheets which are joined together through heat seals only at the common bottom edge 144, and side edges 146*a*, 146*b*. The enclosure 112 is then filed, and the top edges 148 of the polyethylene sheets drawn together for subsequent heat sealing.

To assist in carrying the enclosure 112 and inserting it into the support means 114, preferably the enclosure includes a handle 152 formed in the polyethylene sheets, a distance above the top edge 148. For hygiene and for added strength during storage and transport, preferably the enclosure 112 includes removable outer cover panels 154 which can be peeled away from the polyethylene sheets of the enclosure 112 immediately before use. The enclosure 112 can then be transported or stored in unsterilized reusable crates since the crates do not come into contact with the polyethylene sheets. In one implementation, a single removable outer panel 154 is provided on each polyethylene sheet of the enclosure 112. However, more cover panels 154 may be used, if desired, provided that they fit together to cover the outer surface of the polyethylene sheets.

Figure 5:
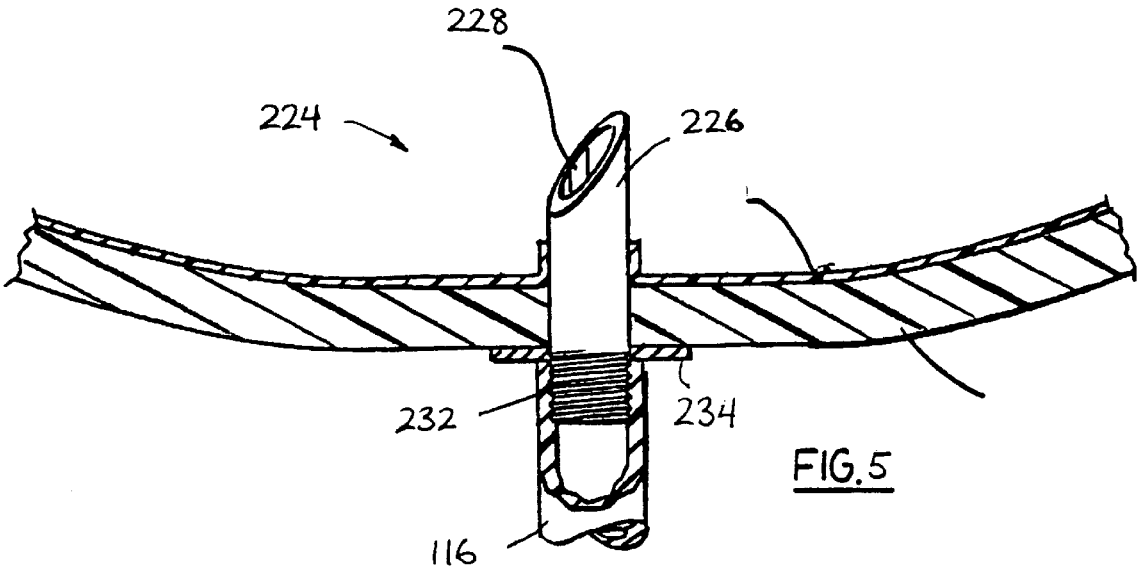
FIG. 5 is a magnified cross-sectional view of one variation of the spigot shown in FIG. 3.

One variation of the spigot 124 will now be discussed with reference to FIG. 5. The spigot 224, shown in FIG. 5, extends through the carrier portion 118, and comprises a tubular head portion 226 terminating in a sharp open end 228 for puncturing the sealed enclosure 112, and a fluid passageway opening into the open end 228. The outer surface of the fluid passageway includes external screw threading 232 adjacent the end of the fluid passageway, and corresponding internal threads are provided in the conduit 116 for securing the spigot 224 to the carrier portion 118. Since the head portion 226 does not have a conical shape, the head portion 226 produces less strain on the punctured portion of the enclosure 112 than the head portion 126. Accordingly, the spigot 224 reduces the risk of the punctured portion turning up from the lowermost portion of the carrier portion 118, thereby also reducing the risk of contamination. However, the tubular shape of the head portion 226 also increases the possibility of fluid leakage occurring between the spigot 224 and the punctured portion of the sealed enclosure 112. Accordingly, a sealing washer 234 is provided between the outer surface of the fluid passageway and the lower surface of the carrier portion 118 to reduce the likelihood of fluid leaking out of the carrier portion 118 from between the sealed enclosure 112 and the spigot 224.

Figure 6A:
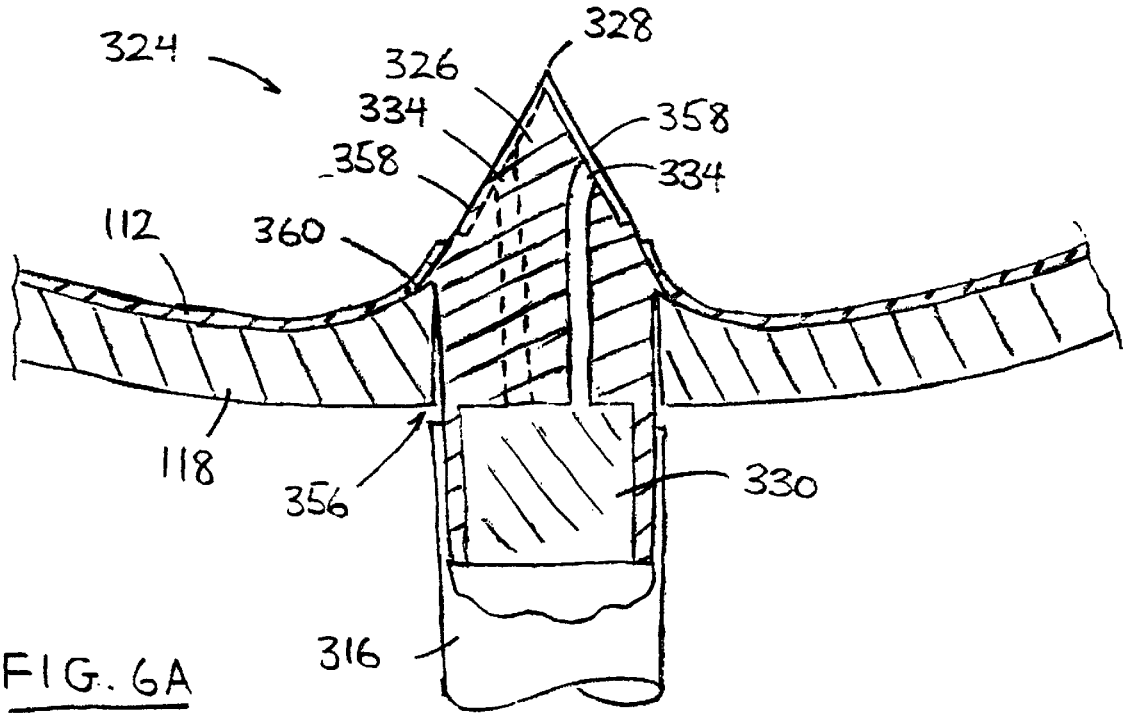
FIG. 6A is a magnified cross-sectional view of another variation of the spigot shown in FIG. 3.
Figure 6B:
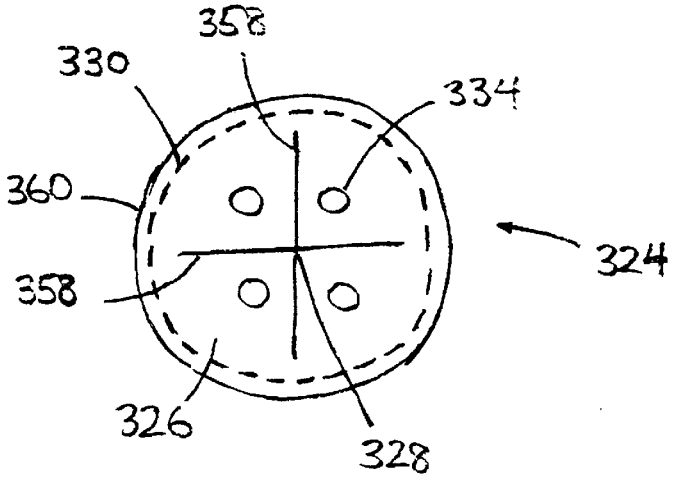
FIG. 6B is a top plan view of the spigot shown in FIG. 6B.

Another variation of the spigot 124 is shown in FIGS. 6*a* and 6*b*. The spigot 324, shown in FIG. 6, comprises a conical head portion 326, extending upwards from the upper surface of the carrier portion 118 and terminating in a sharp apex 328, and a fluid passageway 330 extending through an aperture 356 in the carrier portion 118. The spigot 324 includes a plurality of blades 358 extending radially outwards from the outer surface of the head portion 326 to more readily puncture the sealed enclosure 112. The blades 358 extend axially from the apex 328 and terminate a distance from the base 360 of the head portion 326 to allow the punctured portion of the sealed enclosure 112 to seal against the head portion 326. Fluid inlets 334 are provided between each adjacent pair of blades 358 and extend axially between the head portion 326 and the fluid passageway 330 to pass fluid from the sealed enclosure 112 to the fluid passageway 330.

The outer surface of the fluid passageway 330 is devoid of threads to reduce the risk of bacterial growth in the threads (and therefore in the fluid passageway). Similarly, the inner surface of the conduit 316 is devoid of threads. Instead, the outer surface of the fluid passageway 330 is tapered and the conical head portion 326 of the spigot 324 is pressure fit through the aperture 356 in the carrier portion 118. The diameter of the head portion 326, at the base 360 thereof, is slightly larger than the diameter of the aperture 356 to secure the spigot 324 to the carrier portion 118. The thickness of the carrier portion 118 is increased adjacent the aperture 346 to allow the head portion 326 to be pressed through the aperture 356 without damaging the carrier portion 118. The conduit 316 is pressure fit onto the fluid passageway 330, and optionally includes a clamp (not shown) securing the conduit 316 to the fluid passageway 330.

In operation, the support means 114 is positioned on a substantially horizontal planar surface. The filled enclosure 112 is lifted from the shipping crate through the handle 152, and the cover panels 154 peeled off. The enclosure 112 is then positioned into the carrier portion 118 and the cover 138 laid upon the shoulder 136 of the support means 114 to protect the fluid from becoming contaminated. Since the enclosure 112 is sealed, no fluid will escape from the enclosure 112 while the enclosure 112 is being positioned into the carrier portion 118. Once the enclosure 112 is properly positioned in the carrier portion 118, the weight of the fluid in the enclosure 112 will exert a downward force on the sharp end of the spigot. Generally, the weight of the fluid on the spigot will be sufficient to cause the spigot to puncture the enclosure 112. However, in some circumstances, it may be necessary to exert a downward force on the enclosure 112 of the cover 138 to allow the spigot to puncture the enclosure 112.

After the enclosure 112 is punctured by the spigot, the atmospheric pressure exerted on the enclosure 112 will cause the enclosure 112 to collapse and the fluid retained in the enclosure 112 to flow through the fluid passageway 130 and into the conduit 116. The fluid can then be dispensed by operating the user-operable valve 142. If the cooling elements 140 are active, the fluid contained in the enclosure 112 (and thus the fluid being dispensed) will be chilled.

Figure 7:
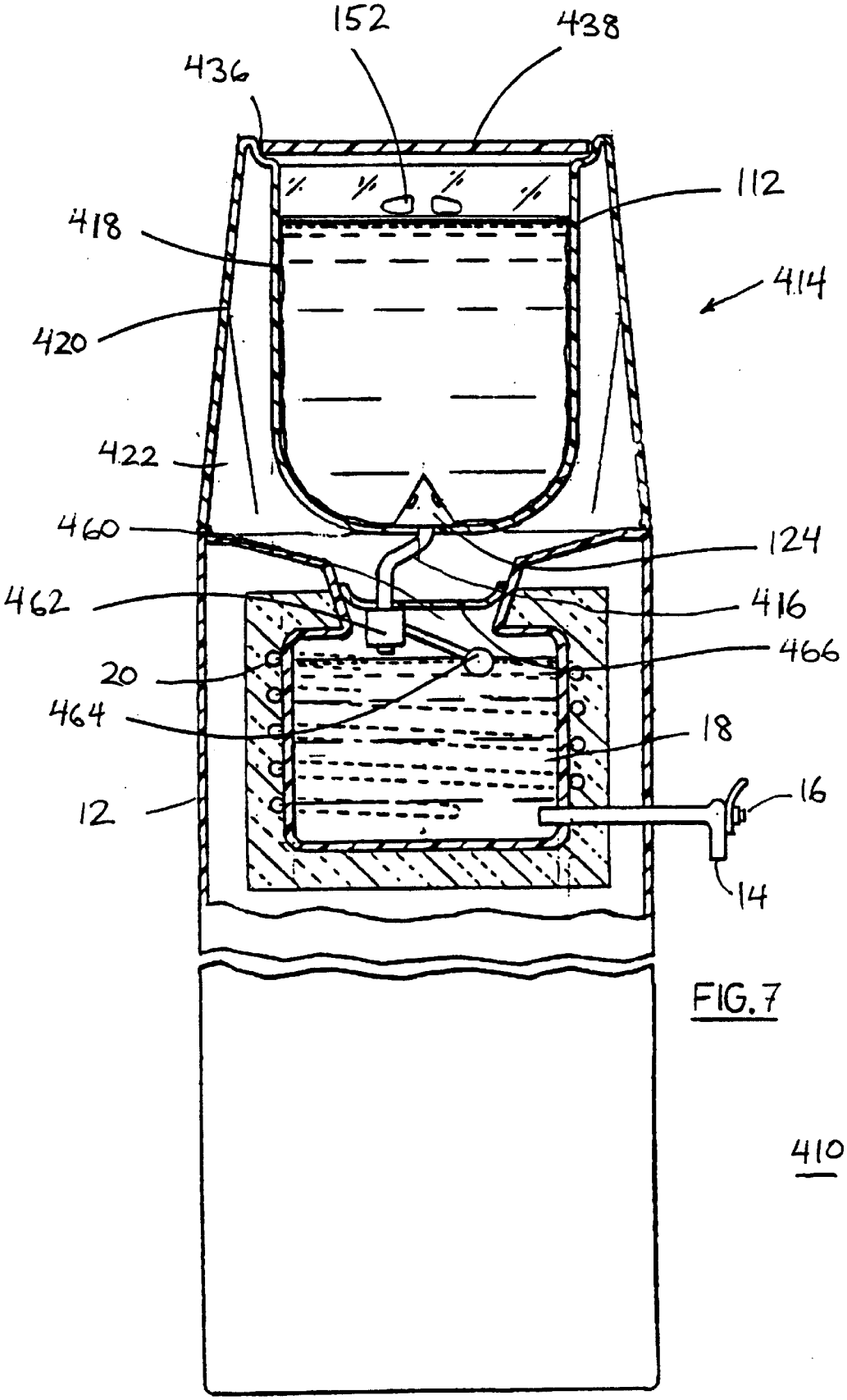
FIG. 7 is a longitudinal cross-sectional view of the fluid dispensing system in accordance with one aspect of the invention, showing the sealed enclosure and the integrally-molded support means positioned on top of a conventional water cooler.
Figure 8:
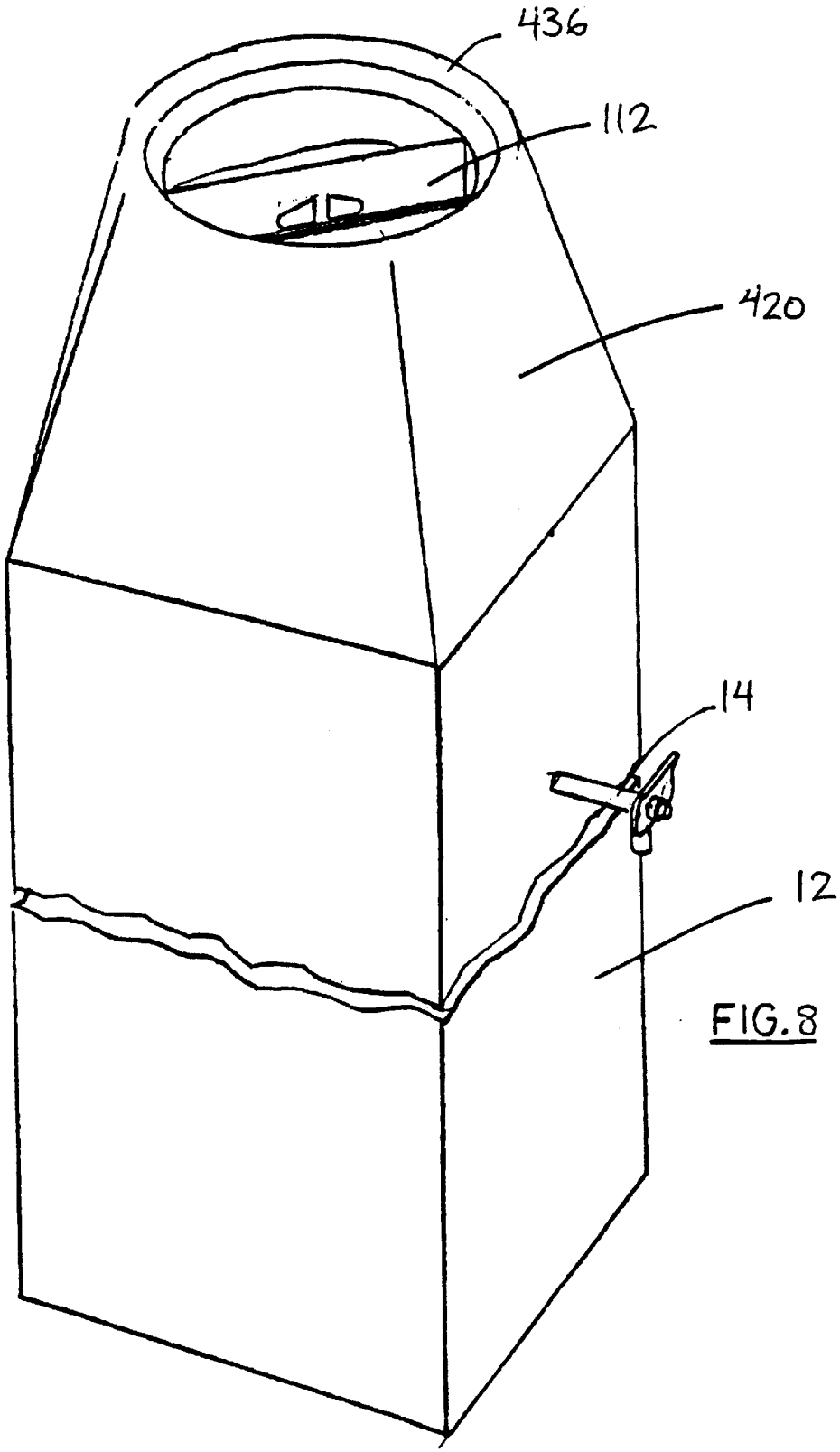
FIG. 8 is a perspective view of the fluid dispensing system of FIG. 7, shown without the sealed enclosure.

A fluid dispenser 410, in accordance with a second embodiment of the invention, will now be described with reference to FIGS. 7 and 8. The fluid dispenser 410 comprises a collapsible sealed enclosure 112 containing fluid therein, support means 414 for supporting the enclosure 112, and a reservoir 18 for retaining and dispensing a portion of the fluid from the enclosure 112. The support means 414 is substantially similar to the support means 114, and comprises a carrier portion 418, and a collar 420 supporting the carrier portion 418. Preferably, the carrier portion 418 is fabricated from food grade virgin plastic resin, and includes a plurality of strengthening ribs 422 integrally molded with the collar 420 to impart stability to the support means 414. A spigot 124 is provided in the carrier portion 418 for puncturing the enclosure 112 after the enclosure 112 is positioned in the carrier portion 418. The spigot 124 includes a fluid passageway extending through an aperture in the carrier portion 218. Preferably, the support means 414 also includes a shoulder 436 adjacent the uppermost portion of the carrier portion 418, and a cover 438 resting on the shoulder 436 to protect the inside of the carrier portion 418 from contamination.

However, unlike the support means 114, the support means 414 is shaped to be disposed on top of a water cooler housing 12 and, together with the enclosure 112, is designed to be used in replacement of the conventional rigid plastic water bottle 22. The water cooler housing 12 includes an access tap 14 for dispensing portions of the fluid, and a flow-control valve 16 provided in the access tap 14 for allowing water to be drawn from the dispenser 410. The reservoir 18 is disposed within the housing 12 below the sealed enclosure 112, and includes an open mouth 460 through which fluid may flow into the interior of the reservoir 18. Preferably a plurality of cooling or heating elements 20 are arranged around the reservoir 18 to cool or heat the fluid prior to being dispensed.

The reservoir 18 communicates with the spigot 124 through a conduit 416 extending between the spigot 124 and the reservoir 18 for conducting fluid from the enclosure 112 to the reservoir 18. The conduit 416 includes a flow control valve 462 for controlling the flow of fluid from the enclosure 112. Preferably, the flow control valve 462 comprises a ballcock control valve positioned in the reservoir 18, including a flotation ball 464 which floats on the surface of the fluid therein. As a result, the flow control valve 462 allows fluid flow from the enclosure 112 into the reservoir 18 when the level of fluid in the reservoir 18 drops below a desired level, and terminates the fluid flow from the enclosure 112 when the level of fluid in the reservoir 18 reaches the desired level.

For further protection against contamination of the fluid, preferably the reservoir 18 includes a cover 466 which covers a substantial portion of the mouth 466, leaving only a small aperture (not shown) through which the conduit 416 extends. In addition, to reduce the likelihood of contaminated fluid leaking out of the support means 414, from between the sealed enclosure 112 and the spigot 124 and into the reservoir 18, a sealing washer (not shown) is provided between the outer surface of the fluid passageway and the lower surface of the carrier portion 418.

The fluid dispenser 410 operates in a manner similar to the fluid dispensing system 110. Specifically, the support means 414 is positioned on top of the water cooler housing 12. The filled enclosure 112 is positioned into the carrier portion 418 and the cover 438 is laid upon the shoulder 436 of the support means 414. Once the enclosure 112 is properly positioned in the carrier portion 418, generally the weight of the fluid in the enclosure 112 will be sufficient to cause the spigot 124 to puncture the enclosure 112. However, as discussed above, in some circumstances, it may be necessary to exert a downward force on the enclosure 112 to allow the spigot 124 to puncture the enclosure 112.

After the enclosure 112 is punctured by the spigot 124, the atmospheric pressure exerted on the enclosure 112 will cause the enclosure 112 to collapse and the fluid retained in the enclosure 112 to flow through the conduit 416 and into the reservoir 18. The fluid will continue to flow until the level fluid has risen to the desired level. At this point, further fluid flow will be terminated by the flow control valve 462. The fluid can then be dispensed from the reservoir 18 by operating the flow-control valve 16 in the access tap 14. If the cooling elements 20 are active, the fluid contained in the reservoir 18 (and thus the fluid being dispensed) will be chilled.

The foregoing description is intended to be illustrative of the preferred embodiments of the invention. Those of ordinary skill will be able to make certain additions, deletions and/or modifications to the described embodiments without departing from the spirit or scope of the invention as defined by the appended claims.

I claim:

1. A fluid dispensing system comprising:

a collapsible sealed enclosure for retaining fluid therein;

support means for supporting the enclosure, the support means including a carrier portion for retaining the enclosure therein, and a collar portion for supporting the carrier portion, the support means being shaped as a paraboloid of revolution;

a spigot coupled to the support means for puncturing the enclosure under at least a weight of the fluid after the enclosure is positioned on the support means, the spigot including a fluid passageway for draining the fluid therethrough; and a conduit coupled to the fluid passageway for dispensing the fluid from the enclosure.

2. The fluid dispensing system according to claim 1, wherein the support means is fabricated to form a plastic material, and the carrier portion is integrally molded with the collar portion.

3. The fluid dispensing system according to claim 2, wherein the plastic material comprises polyvinylchloroethylene.

4. The fluid dispensing system according to claim 1, wherein the spigot is positioned in the carrier portion adjacent a lowermost portion thereof.

5. The fluid dispensing system according to claim 1, wherein the carrier portion includes at least one cooling element disposed thereabout for cooling the fluid retained in the enclosure.

6. The fluid dispensing system according to claim 1, wherein the spigot includes a fluid inlet in fluid communication with the fluid passageway for draining the fluid from adjacent a lowermost portion of the enclosure, the fluid inlet being positioned a distance above the lowermost portion for reducing contamination of the fluid.

7. The fluid dispensing system according to claim 1, wherein the enclosure is fabricated from a thickness of polyethylene sheet, and includes a peel-off cover panel removably affixed thereto for protecting the enclosure.

8. The fluid dispensing system according to claim 7, wherein the enclosure includes a handle adjacent an uppermost portion thereof for manoeuvring the enclosure.

9. A fluid dispenser comprising:

a collapsible sealed enclosure containing fluid therein;

support means for supporting the enclosure;

a spigot disposed in the support means for puncturing the enclosure under at least a weight of the fluid after the enclosure is positioned on the support means, the spigot including a fluid passageway for draining the fluid therethrough;

a conduit coupled to the spigot for receiving the drained fluid, the conduit including a valve for controlling a flow rate of the received fluid; and a reservoir in fluid communication with the conduit fluid passageway for dispensing a portion of the received fluid therefrom.

10. The fluid dispenser according to claim 9, wherein the valve comprises a ballcock supply valve.

11. The fluid dispenser according to claim 9, wherein the support means includes a carrier portion for retaining the enclosure therein, and a collar portion for supporting the carrier portion, the support means being shaped as a paraboloid of revolution.

12. A fluid dispensing assembly for dispensing fluid from a collapsible sealed enclosure, the fluid dispensing assembly comprising:

support means for supporting the enclosure, the support means including a carrier portion for retaining the enclosure therein, and a collar portion for supporting the carrier portion, the support means being shaped as a paraboloid of revolution; and a spigot disposed in the support means for puncturing the enclosure under at least a weight of the fluid after the enclosure is positioned on the support means, the spigot including a fluid passageway for draining the fluid therethrough.

13. The fluid dispensing system according to claim 12, wherein the support means is fabricated from a plastic material, and the carrier portion is integrally molded with the collar portion.

14. The fluid dispensing system according to claim 13, wherein the plastic material comprises polyvinylchloroethylene.

15. The fluid dispensing system according to claim 12, wherein the spigot portion is positioned in the carrier portion adjacent a lowermost portion thereof.

16. The fluid dispensing system according to claim 12, wherein the carrier portion includes at least one cooling element disposed thereabout for cooling the fluid retained in the enclosure.

17. The fluid dispensing system according to claim 12, wherein the spigot includes a fluid inlet in fluid communication with the fluid passageway for draining the fluid from adjacent a lowermost portion of the enclosure, the fluid inlet being positioned a distance above the support means for reducing contamination of the fluid.

* * * * *